United States Patent [19]

Wells

[11] 4,113,482

[45] Sep. 12, 1978

[54] MIGRATION IMAGING METHOD INVOLVING COLOR CHANGE

[75] Inventor: John B. Wells, Savannah, N.Y.

[73] Assignee: Xerox Corporation, Stamford, Conn.

[21] Appl. No.: 735,344

[22] Filed: Oct. 26, 1976

Related U.S. Application Data

[60] Division of Ser. No. 651,301, Jan. 22, 1976, abandoned, which is a division of Ser. No. 406,056, Oct. 12, 1973, which is a continuation-in-part of Ser. No. 199,683, Nov. 17, 1971, abandoned, which is a continuation-in-part of Ser. No. 863,507, Oct. 3, 1969, abandoned.

[51] Int. Cl.[2] ..... G03Q 13/22

[52] U.S. Cl. ..... 96/1 PS; 96/1.5 R

[58] Field of Search ..... 96/1 R, 1 PS, 1 M; 427/369

[56] References Cited

U.S. PATENT DOCUMENTS

| | | | |
|---|---|---|---|
| 2,940,847 | 6/1960 | Kaprelian | 96/1.5 X |
| 3,206,600 | 9/1965 | Gold | 96/1 R X |
| 3,350,205 | 10/1967 | Goffe | 96/1 R X |
| 3,462,338 | 8/1969 | Stein | 427/369 X |
| 3,707,368 | 12/1972 | Van Dorn | 96/1 M |
| 3,723,112 | 3/1973 | Luebbe | 96/1 M X |
| 3,775,103 | 11/1973 | Sadamatsu et al. | 96/1 R |
| 3,801,314 | 4/1974 | Goffe | 96/1 PS |
| 3,804,618 | 4/1974 | Forest et al. | 96/1 R |
| 3,853,555 | 12/1974 | Reinis et al. | 96/1.5 X |

*Primary Examiner*—Roland E. Martin, Jr.
*Attorney, Agent, or Firm*—J. J. Ralabate; A. A. Machoisel; E. O. Palazzo

[57] ABSTRACT

A finely divided imaging composition is provided comprising at least two differently colored pigment particles dispersed and bound in a polymeric matrix, at least one of said particles of said matrix being electrically photosensitive, said imaging composition exhibiting the resultant color of the differently colored pigments and being capable of forming images in said resultant color without color or particle separation. Images formed of this compositon can be selectively modified.

1 Claim, 1 Drawing Figure

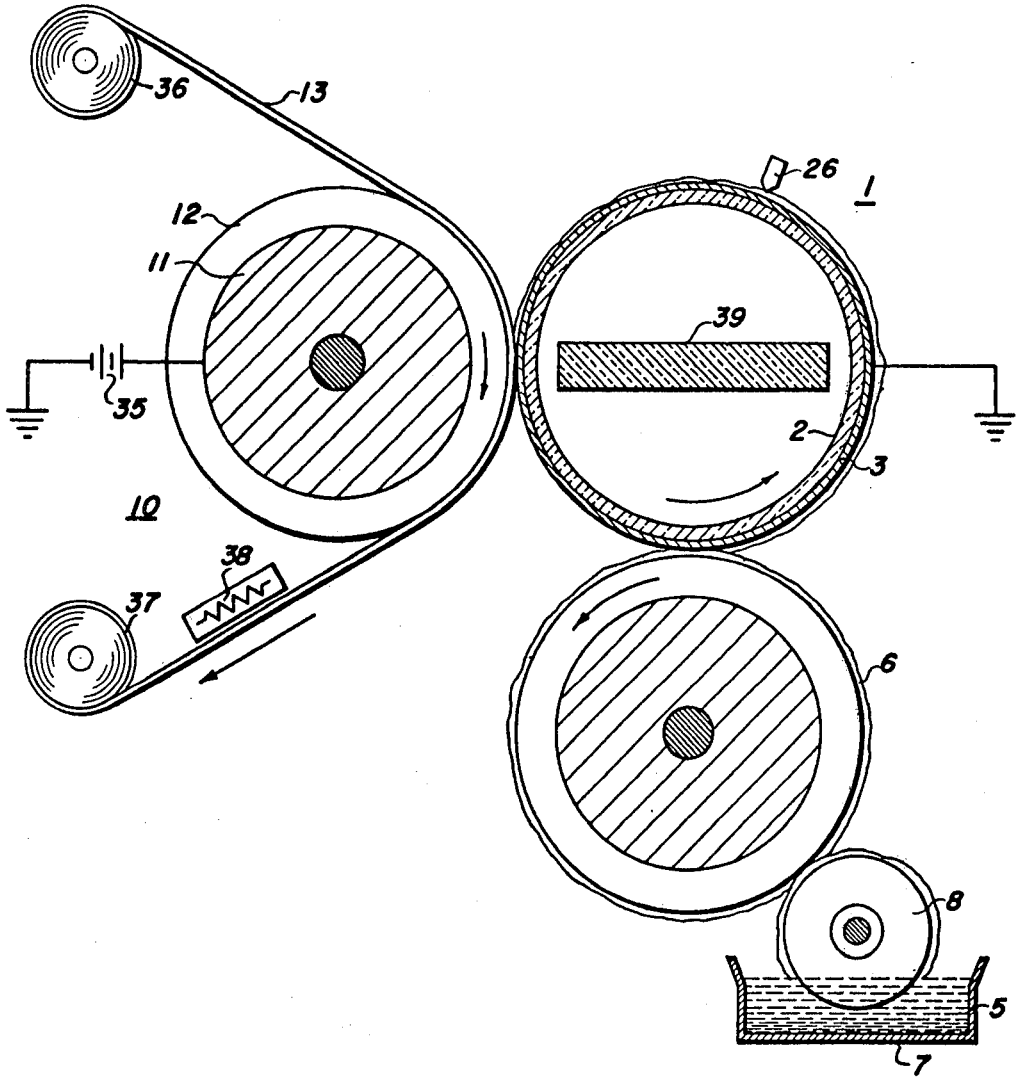
36
13
26
1
12
11
39
35
2
3
10
38
37
6
8
5
7

MIGRATION IMAGING METHOD INVOLVING COLOR CHANGE

This application is a division of application Ser. No. 651,301, filed Jan. 22, 1976, now abandoned; which is a division of application Ser. No. 406,056, filed on Oct. 12, 1973; which is a continuation-in-part of application Ser. No. 199,683, filed on Oct. 17, 1971, now abandoned; which is a continuation-in-part of application Ser. No. 863,507, filed on Oct. 3, 1969, now abandoned.

This invention relates to imaging compositions. More particularly, this invention relates to an extremely versatile class of photoconductive imaging compositions which can be employed in diverse reproduction systems and surprisingly provide the ability to selectively change the color of the resultant image.

A wide variety of reproduction systems have been developed to accommodate the diverse needs of modern business, industry and science. Concomitantly, a multitude of imaging materials have been developed for use with these different systems. Generally, because of specific requirements associated with each of these respective systems, different imaging compositions have been developed specifically for each of these systems. It is readily apparent that substantial reductions in the complexities of these systems together with a substantial savings could be obtained if a substantially universal imaging composition could be developed which could be employed in a great many, if not in substantially all of such reproduction systems.

Accordingly, it is an object of the present invention to provide imaging compositions which can be used in a variety of reproduction systems.

Another object of the present invention is to provide imaging compositions which can be employed in a diversity of reproduction systems despite requirements of each reproduction system which are generally peculiar to said system.

Still a further object of the present invention is to provide imaging compositions which can be employed in a variety of reproduction systems and which can overcome many of the deficiencies which are currently characteristic of the imaging compositions employed therein.

Another object of the present invention is to provide imaging compositions which change color when altered thereby allowing selective change of color of the resultant image.

A further object of the present invention is to provide particulate imaging compositions comprising a resin matrix containing pigments, wherein the resin or at least one of said pigments is photosensitive. These pigments are bound in the resin matrix and exhibit an initial resultant color determined by the optical interaction between the pigments. These imaging compositions can undergo particle migration or effect development without particle or color separation but can undergo color change after image formation.

These as well as other objects are accomplished by the present invention which provides imaging compositions comprising at least two differently colored pigment particles dispersed and bound in a polymeric matrix, at least one of said particles or said polymeric matrix being electrically photosensitive, said imaging compositions exhibiting the resultant color of the differently colored pigments and being capable of forming images in said resultant color without color separation.

The images formed by the imaging compositions of this invention, as stated above, do not allow color separation during image formation. However, the resultant monochromatic image can be selectively treated to produce a surprising change in color so as to provide a two color image. For example, a black image can be treated to produce a green color. In this way, portions of a monochromatic image can be highlighted or accented by color change. The means of communicating by means of images, weather graphs, charts, pictorial or otherwise has achieved yet greater convenience and ease through the methods and images of this invention. The simplicity of color accent which the method of this invention provides when coupled to modern true color copying technology greatly enhances and expands the utility of graphic and pictorial communication.

Color alteration of images produced by employing compositions of this invention is achieved by subjecting the image to conditions whereby the matrix of the imaging composition is disrupted. The disruption of the matrix alters the covering power of at least one of the pigments thus producing a change in color. Most conveniently, the disruption is produced by simply rubbing the image. In some cases an overlayer of protective film is placed on the image and pressure is transmitted through the overlayer to the image to produce the color altering disruption. Preferable the overlayer is sufficiently transparent so as to permit a view of the image below through the overlayer. Because of the simplicity and availability of the instrument, the process of this invention will be described and demonstrated by example hereinbelow utilizing a smooth metal rod with the technique of rubbing the image with hand pressure.

While the mechanism of the process of color change is not yet clearly understood, the rubbing under pressure of the imaging compositions of this invention causes a disruption of the matrix which in some cases appears as a smear of the composition on its supporting substrate. Thus one aspect of the method of this invention is to smear the imaging composition by rubbing the composition with sufficient pressure. Other mechanisms of disruption will occur to those skilled in the art.

Preferably the image is fixed to the substrate prior to alteration a preferred instrument for alteration by means of pressure is a hard smooth surface such as the end of a small metal rod or the like. Other materials such as plastics or wood can also be employed. Smoothness of the rubbing instrument is desired so as to avoid excessive removal of the imaging composition and abrasion of the substrate supporting the image. In addition rough surface instruments tend to scatter the image composition thus effectively blurring the image. Smooth surface instruments achieve color change by hand pressure over the image on its substrate. Image blurring is avoided by confining the rubbing to the area on the substrate occupied by the image. Thus the size of the instrument employed to rub the image is varied to best conform to the image size being rubbed.

While the mechanism of color change is not yet understood, some variation in method has been observed. In most instances very little image composition is removed from the substrate by the rubbing step and in no case is there any selective removal on the basis of color. In some cases, such as in photoelectrophoretic imaging the surface of the black image is effectively removed by abrasion leaving a green image. However, such method is not preferred because image density is reduced. Rubbing the image provides dense images capable of being copied in true color by varius means such as silver halide photography xerographic, electrophoretic, photoelectrophoretic and other known techniques.

In order to gain a better understanding of the versatile and substantially universal nature of the photosensitive imaging composition of the present inventon, several different reproduction systems wherein the imaging compositions of the present invention find utility are briefly set forth below. It is to be understood that these reproduction systems are merely for purposes of illustration and are by no means intended to limit the scope of application of the present invention.

Xerography

The formation and development of images on photosensitive surfaces by electrostatic means is well known. The basic xerographic process, as taught by C. F. Carlson in U.S. Pat. No. 2,297,691, involves depositing a uniform electrostatic charge of a photosensitive insulating layer, exposing the layer to a light-and-shadow image to dissipate the charge on the areas of the layer exposed to the light and developing the resulting electrostatic latent image by depositing on the image a finely divided electroscopic imaging material referred to in the art as "toner". The toner will normally be attracted to those areas of the layer which retain a charge, thereby forming a toner image corresponding to the electrostatic latent image. This powder image may then be transferred to a receiving surface such as paper. The transferred image may subsequently be permanently affixed to the receiving surface by fusing with heat. Instead of latent image formation by uniformly charging the photosensitive layer and then exposing the layer to a light-and-shadow image, one may form the latent image by directly charging the layer in image configuration. The powder image may be fixed to the photosensitive layer if elimination of the powder image transfer step is desired. Other suitable fixing means such as solvent or overcoating treatment may be substituted for the foregoing heat fixing step.

Similar methods are known for applying the electroscopic particles to the electrostatic latent image to be developed. Included within this group are the "cascade" development technique disclosed by E. N. Wise in U.S. Pat. No. 2,618,552; the "powder cloud" technique disclosed by C. F. Carlson in U.S. Pat. No. 2,221,776 and the "magnetic brush" process disclosed, for example, in U.S. Pat. No. 2,874,063.

Electrography

If desire, an electrostatic latent image can be formed on an insulating medium by charge transfer between at least two electrodes. This electrostatic latent image can then be developed in the manner described above with respect to xerography. The electrostatic latent image is formed on an insulating recording web such as plastic-coated paper by the creation of an intense electric field in the shape of a character or symbol. For example, a raised metal character much like that used in a typewriter can be positioned a few thousandths of an inch above a sheet of dielectric. A base electrode located directly behind the dielectric serves to support the dielectric medium and also as a terminal for the electric field. As the potential between the metal character electrode and the base electrode is increased, an electric field is produced in the printing gap with lines of force emanating from the positive electrode and terminating in the negative electrode. As the potential is increased, a current will carry electric charge through the bulk of the paper to the plastic-paper interface. This moves the actual base electrode from the back of the recording medium to the interface and increases the electric field in the printing gap. Free electrons which are present in the printing gap due to natural ionization are accelerated toward the plastic surface thereby forming an electrostatic latent image directly on the insulating surface.

Many times, it is desirable to transfer the electrostatic latent image from a photoconductive or insulating surface to an insulating surface. This transfer process has been termed "TESI", an acronym for Transfer of Electrostatic Images. This transfer may be carried out for either of two purposes. The electrostatic latent image may be transferred to the surface of an electrically insulating material, upon which it will be stored for later readout by a scanning device, or it may be intended for xerographic development to produce a visible image. The transfer process is advantageous in that it permits a delicate photoreceptor to be used solely to record the electrostatic image, leaving the development, transfer and cleaning steps to take place on a more rugged insulating surface. Or, since an image can be transferred quickly to an insulator for later development or readout, transfer makes practical the use of photoconductors with high dark decay rates in the xerographic process.

A more detailed description of electrography and TESI can be found in British Pat. specification No. 734,909 to C. F. Carlson and U.S. Pat. Nos. 2,825,814; 2,833,648; 2,934,649 and 2,937,943 to L. E. Walkup.

In xerographic or electrographic reproduction systems, imaging or toner compositions are desired which are generally black and which can be radiantly fused on an efficient basis. In high speed xerographic devices, however, problems arise in attempting to rapidly fuse conventional toners. Thus, with conventional toners, the pigment, generally carbon black, absorbs too much radiant energy in the surface layers thereof exposed to radiant energy. Under certain conditions, these areas attain very high surface temperatures actually causing the polymeric binder to degrade and the toner particle to explode. Attempts to alleviate this problem have heretofore been generally unsuccessful. For example, a soluble black dye such as nigrosine has been substituted in lieu of the carbon black pigment in a polymeric binder. It has been found, however, that black dyes, although capable of forming black images, are generally too transparent to absorb enough energy for efficient thermal fusion to occur.

Electrophoretic Imaging

Development of an electrostatic latent image can also be achieved with liquid rather than dry developer materials. In conventional liquid development, more commonly referred to as electrophoretic development, an insulating liquid vehicle having finely divided solid imaging materials dispersed therein contacts the imaging surface in both charged and uncharged areas. Under the influence of the electric field associated with the charged image pattern, the suspended imaging particles migrate toward the charged portions of the imaging surface separating out of the insulating liquid. This electrophoretic migration of charged particles results in the deposition of the charged imaging particles on the image surface in image configuration.

Electrophoretic development involves the phenomena of electrophoresis which can be defined as the movement of charged particles suspended in a liquid under the influence of an applied electric field. If the electric field is applied between electrodes in a cell, the particles will migrate, depending upon their polarity to either the anode or cathode, with the liquid medium remaining essentially stationary. When a photoconductive or insulating surface bearing an electrostatic latent image thereon is immersed in or contacted with an insulating liquid containing suspended solid particles, the electric field associated with the image will cause electrophoresis to occur. Depending upon the polarity of charge on the surface and the particles, either charged area development or discharged area development can occur to provide a photographically positive or negative visible image.

The finely divided imaging compositions of the present inventon when dispersed in an insulating liquid become electrically charged upon contact with the continuous phase and thus can serve as an electrophoretic developer composition. This developer composition is highly versatile because the particle size of the imaging composition can be easily controlled as described herein. Moreover, the imaging compositions of the present invention provide great latitude in color selection depending upon the particular makeup of the imaging compositions. Moreover, the polymeric matrix of the imaging compositions of the present invention provide a built-in means of fixing the image on the ultimate copy sheet.

At any inter-face between two phases, there exists an electrical double layer, the positive charges being associated with one phase and the negative charge with the other. The imposition of an electrical force on the electrical double layer causes mechanical displacement of one phase with respect to the other. If the liquid phase is stationary and the solid particles migrate, the phenomenon is called electrophoresis. Therefore, electrophoresis can be defined as an electrokinetic phenomenon which involves the motion of charged particles through a stationary dispersion medium under the influence of an applied electric field. Liquid development of electrostatic latent images in electrostatography is, in essence, electrophoresis in an electrically insulating liquid medium in response to the fields associated with an electrostatic image.

The electrophoretic imaging process and electrophoretic developer compositions are described in more detail, for example, in U.S. Pat. No. 2,877,133 to E. F. Mayer, U.S. Pat. No. 2,890,174 to E. F. Mayer, U.S. Pat. No. 2,899,335 to V. E. Straughan, U.S. Pat. No. 2,892,709 to E. F. Mayer and U.S. Pat. No. 2,913,353 to E. F. Mayer et al.

It has been found difficult to obtain dense black images of high resolution with the electrophoretic process. Most carbon black dispersions, for example, have been found to be unstable and incapable of producing high resolution images over extended periods of time, because even dispersant-treated carbon blacks, charcoal and similar inorganic black pigments have shown strong tendencies to aggregate and settle when added to an insulating liquid. Thus, control of particle size is of great importance in electrophoretic deposition. It would be highly desirable to provide an imaging composition which could be directly dispersed in an insulating liquid without the problem of agglomeration. Moreover, it would be highly desirable to provide an electrophoretic developer composition which could readily provide dense black images.

In electrophoretic development, fixing of the imaging composition is not considered a serious problem as it is in xerographic or electrographic imaging systems. Here, however, control of the particle size of the imaging composition is very important. Additionally, the imaging composition must exhibit stable unipolar properties for successful operation resulting in low background images.

Heretofore, photoconductive developer compositions have not generally been employed for xerographic, electrographic or electrophoretic processes. It is, however, considered advantageous to employ said photoconductive imaging compositions in such processes since after development, any residual charge on the toner particles can be photo-discharged by blanket illumination of the developed image thereby facilitating subsequent transfer. Additionally, photoconductive toners have been employed directly for imaging. For example, British patent specificaton No. 1,165,017 describes an electrophotographic process wherein a layer of photoconductive toner particles are electrostatically bonded to a conductive substrate, exposed to an image pattern of electromagnetic radiation, the exposed particles are removed and the remaining particles in image configuration are either fixed to the substrate or to another substrate after transfer.

Photoelectrophoretic Imaging

In photoelectrophoretic imaging, colored photosensitive particles are suspended in an insulating carrier liquid. this suspension is then placed between at least two electrodes subjected to a potential difference and exposed to a light image. Ordinarily, in carrying out the process, the imaging suspension is placed on a transparent electrically conductive support in the form of a thin film and exposure is made through the transparent support while a second generally cylindrically shaped biased electrode is rolled across this suspension. Although not wishing to be bound by any theory of mechanism, it is currently believed that the particles bear an initial charge once suspended in the liquid carrier which causes them to be attracted to the transparent base electrode upon application of the potential difference. Upon exposure, the particles change polarity by exchanging charge with the base electrode so that the exposed particles migrate to the second or roller electrode thereby forming images on each of the electrodes by particle subtraction, each image being complementary one to the other. The process may be used to produce both polychromatic and monochromatic images. In the latter instance a single color photoresponsive particle may be used in the suspension or a number of differently colored photoresponsive particles may be used all of which will respond to the light to which the suspension is exposed. An extensive and detailed description of the photoelectrophoretic imaging techniques as generally referred to may be found in U.S. Pat. Nos. 3,383,993; 3,384,488; 3,384,565 and 3,384,566 which are hereby incorporated by reference.

Although it has been found that good quality images can be produced in photoelectrophoretic imaging, obtaining a high quality image of many specific colors such as black, specifically in the monochrome imaging process, has been found lacking. For example, a search for an efficient, photosensitive single black pigment has not generally been successful. Ordinarily, in photoelectrophoretic imaging, in order to obtain a black image, magenta, cyan and yellow pigments are superimposed one upon the other in registration in a manner similar to that in conventional printing. In addition to not obtaining the highest quality black image by this technique, other problems are introduced such as the need for exact registration of the respective images in order to obtain the end result. Previous attempts to produce a black ink utilizing duo-mix pigments and tri-mix pigments have resulted in color separation causing high print background and poor color distribution. Furthermore, due to the interaction between the various pigment particles and polarity differences in the imaging suspension, it is difficult upon exposure to white light to obtain completely balanced migration of the three complementary colors so as to produce a true black image since the photosensitive pigments respond to their own wavelength; whereas, the relatively non-photosensitive pigments do not migrate. These same problems ae encountered when attempting to reproduce many other heretofore unattainable colors.

Migration Imaging

Other imagin processes whrein the photosensitive imaging compositions of the present invention find utility are the migration imaging systems such as described in U.S. Pat. No. 3,520,681 to W. L. Goffe, U.S. Ser. No. 837,780 filed June 30, 1969 and U.S. Ser. No. 837,591 filed Jun. 30, 1969 all of which are incorporated herein by reference.

In a typical embodiment of migration imaging systems, an imaging member comprising a conductive substrate or a substrate having a conductive layer with a layer of softenable or soluble material, containing photosensitive particles, overlying the substrate is imaged in the following manner: a latent image is formed on the member, for example, by uniformly electrostatically charging and exposing it to a pattern of activating electromagnetic radiation. The imaging member is then developed by exposing it to a solvent or heat which dissolves or softens only the softenable layer. The photosensitive particles which have been exposed to radiation migrate through the softenable layer as it is dissolved or softened, leaving an image on the conductive substrate conforming to a negative of the original. This is known as a positive-to-negative image. Through the use of various techniques, positive-to-positive or positive-to-negative images may be made depending on the materials used and the charging polarities. Those portions of the photosensitive layer which do not migrate to the conductive substrate may be washed away by the solvent with the softenable layer or, depending upon whether a solvent or heat was employed, the softenable layer may at least partially remain behind on the substrate.

In general, three basic imaging members can be used;

(1) a layer configuration which comprises a substrate coated with a layer of softenable material, and a fracturable and preferably particulate layer of photosensitive material on or embedded at or near the upper surface of the softenable layer;

(2) a binder structure in which the photosensitive particles are dispersed in the softenable layer which overcoats a substrate; and (3) an overcoated structure in which a substrate is overcoated with a layer of softenable material followed by an overlayering of photosensitive particles and a second overcoating of softenable material which sandwiches the photosensitive particles.

The imaging system described in U.S. Pat. No. 3,520,681 generally comprises a combination of process steps which include forming a latent image and developing with solvent, liquid or vapor, or heat or combinations thereof to render the latent image visible. In certain methods of forming a latent image, non-photosensitive or inert, fracturable layers and particulate material may be used to form images, as described in copending application Ser. No. 483,675 filed Aug. 30, 1965 and assigned to the same assignee herein. In that application, a latent image can be formed by a wide variety of methods including charging in image configuration through the use of a mask or stencile or forming a charge pattern on a separate photoconductive insulating layer according to conventional xerographic reproduction techniques, then transferring this charge pattern to the imaging member by bringing the two layers to very close proximity and utilizing breakdown techniques as described, for example, in Carlson U.S. Pat. No. 2,982,647 and Walkup U.S. Pat. Nos. 2,825,814 and 2,937,943. In addition, charge patterns conforming selected, shaped electrodes or combinations of electrodes may be formed by the "TESI" discharge technique as more fully described in Schwertz U.S. Pat. Nos. 3,023,731 and 2,919,967 or by techniques described in Walkup U.S. Pat. Nos. 3,001,848 and 3,001,849 as well as by electron beam recording techniques, for example, as described in Glenn U.S. Pat. No. 3,113,179.

In the above described imaging systems, the layer of softenable material of the imaging member in some developing techniques is (a) substantially completely washed away (wash-away development) and in other developing techniques (b) (softening development) may at least partially remain behind on the supporting substrate.

In copending application Ser. No. 837,780, referred to above, there is described an imaging member comprising a layer of migration material spaced apart from at least one surface of, but contacting a softenable layer wherein material from said layer of migration material is caused to imagewise migrate to at least locations in depth in the softenable layer by (a) subjecting said migration material to an imagewise migration force and changing the resistance of said softenable layer, to migration of migration material or by (b) subjecting said migration material to a migration force and imagewise changing the resistance of said softenable layer to migration of the migration material. In one embodiment of this imaging system, an imaging member is provided comprising a substrate, an electrically insulating softenable layer which contains at its upper surface a fracturable migration layer of particulate material. The substrate can be electrically conductive or insulating. Conductive substrates or substrates having conductive surfaces generally facilitate the charging or sensitization of the member. The softenable layer may be coated directly onto the conductive substrate, or alternatively, the softenable layer may be self-supporting and may be brought into contact with a suitable substrate during imaging. The softenable layer may comprise one or more layers of softenable material and can be any suitable material typically a plastic or thermoplastic material which is soluble in a solvent or softenable, for example, in a solvent liquid, solvent vapor, heat or combinations thereof, and in addition is optimally substantially electrically insulating during the migration force applying and softening steps.

"Softenable" as used herein to depict the softenable layer is intended to mean any material which can be rendered by the developing step more permeable to particles migrating through its bulk. Conventionally, changing permeability is accomplished by dissolving, melting and softening as by contact with heat, vapors, partial solvents and combinations thereof.

The migration layer, portions of which migrate towards or to the substrate during image formation under influence of the migration forces can, in one embodiment, be a fracturable layer of particles. While it is preferred for images of highest resolution, density and utility that the migration layer be a fracturable layer and optimally that the fracturable material be particulate, the migration layer may comprise any continuous or semi-continuous, fracturable layer such as a swiss cheese pattern, which is capable of breaking up into discrete particles of the size of an image element or less during the development step and permitting portions to migrate towards the substrate in image configuration.

Alternatively, the migration layer may be non-fracturable. It has been shown that a non-fracturable, semi-continuous layer may imagewise migrate in depth in the softenable material. It is preferred that the material be at least semi-continuous, such as a swiss cheese pattern, to allow it more readily to migrate into the softenable layer.

In copending application Ser. No. 837,591 referred to above, still another migration imaging system is described. In this system a binder structured imaging member is employed wherein the migration marking particles are dispersed througout a softenable layer which typically overcoats a substrate.

Such binder structured imaging members may be imaged by any type of migration imaging procedure. Imaging usually includes providing a binder structured migration imaging member and causing the migration marking material of said member to migrate imagewise in increasing depth in the softenable material by imaging steps comprising subjecting the migration material to a migration force and changing the resistance of said softenable layer to migration of the migration material. Such procedures often typically involve charging and exposing, followed by development in a suitable solvent, its vapors, or by heat, as described hereinabove.

The support member for the binder structure imaging member can be either electrically conductive or insulating. If desired, a conductive substrate may be coated on an insulator such as paper, glass or plastic. It will be appreciated that in various modes of the imaging system, binder matrix layers comprising marking material dispersed in the softenable layer may themselves be sufficiently self-supporting to allow their preparation separate and apart from the imaging substrate. Such self-supporting imaging members may be imaged by processes involving selectively softening only portions of the area or thickness of the softenable material while the unsoftened portions thereof maintain sufficient integrity to continue to support the member. Typically, such a migration imaging binder matrix is placed in contact with a suitable, desired substrate before or during the migration imaging process. Imaging processes using a binder structured imaging member having an insulating substrate may be accomplished by any of the methods described for use with the imaging member having a conductive substrate, by additionally placing the insulating substrate of this imaging member in contact with a conductive member, typically grounded, and then creating the imagewise migration force across the imaging member, for example, by charging with a corona charging device. Alternatively, other methods known in the art of xerography for charging xerographic plates having insulating backings may also be applied. For example, the imaging member having the insulating substrate may be moved between two corona charging devices thereby simultaneously charging both surfaces to opposite potential. This last described method is often referred to as "double-sided charging".

The imaging process by which the variously structured migration imaging members are imaged typically comprises the following steps. First, an imagewise migration force, which is typically an electrical field interacting with charged particles, is placed across the thickness of the imaging member. The softenable layer is then softened by the application of any suitable softening medium, and as the softenable layer is softened, the migration marking material migrates in imagewise configuration towards the surface of the substrate. In various embodiments of the migration imaging system, the imagewise migration force applying and softening steps may be performed simultaneously or in inverse order with perfectly satisfactory results.

In a typical system, the migration imaging member is substantially uniformly electrostatically charged. The electrostatic charging steps is typically accomplished by means of a corona charging device whch scans the upper surface of the member and deposits uniform charge on its upper surface as it passes over the structure. During the electrostatic charging step, the substrate is typically electrically grounded for preferred results. After the surface of the imaging member has been uniformly charged, the charged imaging member is exposed to a selective pattern of activating electromagnetic radiation as for example, light. The imagewise exposure may be before, during or after charging and before or during the period when the softenable layer is in a softened condition wherein the photosensitivity employed is permanent, persistent or temporary. Also, the latent image may result from the heating effects of the incident radiation pattern, either on the softenable layer or the migration marking material to produce an imagewise change in conductivity thereby producing an electrical migration force pattern. The exposure may either be made from, for example, the binder layer side, or through the rear of a member, with a softenable layer and a support, if used, which are at least partially transparent to the activating radiation. Any suitable means for producing a selective image pattern of activating radiation may be used for exposing the charged imaging member in accordance with this process step. For example, an optical mask, such as an ordinary photographic transparency, may have light projected through it by conventional projection apparatus, which can also focus the selected image pattern upon the charged migration imaging member as desired. Following exposure, the charged imaging member supports a pattern of electrostatic charge in imagewise configuration typically conforming to a negative of the selected pattern of activating radiation to which the charged member was exposed. The exposed imaging member supporting the electrostatic latent image is then developed by softening the softenable layer by any suitable means. For example, the imaging member can be developed by immersion in a solvent liquid which is contained in a suitable bath or tank. Development by the application of a solvent liquid is commonly referred to as "wash-away" development.

During development, the previously charged photosensitive particles which have not been exposed to radiation, migrate through the softened layer as it is softened and dissolved, and adhere to the conductive substrate in imagewise configuration. Unmigrated particles are washed away from the developing imaging member in a solvent bath. Thereafter, the fully developed migration imaging member is then suitable for use in a process whereby the image is fixed to the substrate where such fixing is desirable.

In addition to the charge-expose mode of providing an imagewise migration force across a migration imaging member, it is noted that any means for providing such migration force may be suitable for use. Broadly, the imaging methods can be divided into two modes:

(A) applying to the migration marking material an imagewise migration force, which typically is associated with a latent imagewise change of the imaging member which changes directly or indirectly the force on the migration material towards the bulk of the softenable layer and typically towards a face of the softenable material or, where a substrate is used, towards the substrate-softenable interface; said migration material force-applying step occuring before, during or after a second step of changing the resistance of said softenable material to migration of migration material; and (B) applying to the migration marking material a migration force before, during or after a second step of imagewise changing the resistance of said softenable material to migration of migration material.

By either mode (A) or (B) above, there are a variety of forces which can be applied to and be made to act on the migration marking material to cuase it to move in image configuration in depth in a softenable layer. Such forces include electrical or electrostatic, magnetic, gravitational and centrifugal forces.

The development step in the migration imaging process has been described above with respect to the liquid solvent wash-away development mode. It should be clear that any suitable means may be used for softening or dissolving the softenable layer, thereby rendering the softenable material sufficiently permeable to migration of the migration marking material to permit migration or to permit what is often a latent imaged member after the migration force applying step hereof to become visibly (or detectably by other means) imaged.

For example, liquid solvents, vapor solvents, heat or combinations thereof are typically suitable for accomplishing the development. The image effect is produced by the migration marking material imagewise migrating in depth into the bulk of the softenable layer. Softening may occur prior, during or following the step of application of the migration force to the migration material and it is the mechanism which permits selected portions of the migration material to imagewise migrate to locations in depth in the softenable layer, while the remaining migration material may remain substantially unmigrated, in the softenable material or migrate a shorter distance in the softenable material.

Softening herein encompasses any suitable means for rendering the softenable layer more permeable to the migration marking material including such preferred modes as softening the softenable layer by subjecting it to heat or a vapor of a solvent for the softenable material or combinations thereof, or by relatively short duration exposing of the softenable layer to a solvent therefore to cause swelling and some softening of the softenable layer. Softening also encompasses the case where the softenable material off the shelf, is sufficiently softened to render unnecessary a separate, distinct softening process. For example, the migration material could be deposited in a layer which is softened enough by room temperature so that upon completion of the migration force applying step, migration images are formed simultaneously, or soon thereafter.

When employing heat softening development, generally, the member is heat softened by exposing the imaging structure, for example, for a few seconds to hot air, infrared exposure, by contacting the substrate with a heated platen, or by dipping the imaging member in a heated non-solvent liquid, such as silicone oil.

Despite the wide versatility of migration imaging members, however, it has heretofore been found quite difficult to obtain black marking particles which provide dense black images, high contrast, good resolution and low background in the current migration imaging systems.

Manifold Imaging

A further imaging system which can advantageously employ the photoconductive imaging compositions of the present invention utilizes a manifold imaging system comprising an electrically photosensitive cohesively weak imaging layer sandwiched between a donor sheet and a receiver sheet. An electric field is imposed across the imaging layer and the imaging layer is exposed to imagewise actinic electromagnetic radiation. Upon separation of the donor and receiver sheets, the imaging layer fractures in imagewise configuration corresponding to the imagewise exposure with the positive image adhering to one of the sheets and a negative image adhering to the other sheet. Although imaging layers can be prepared which are themselves sufficiently cohesively weak to respond to the application of light and electric field, a larger range of materials may be used if and "activating" step is included in the process. The activating step serves to weaken the imaging layer so that it can be more easily fractured along a sharp line which defines the image to be reproduced. Conventionally, the imaging layer is activated by heating or by treating it with a swelling agent or partial solvent for the material prior to placing the imaging layer between the donor and receiver sheets. The activating step can be omitted if, for example, the layer retains sufficient residual solvent after being coated on substrate from a solution or paste to render the layer cohesively weak.

The structure of the manifold imaging member can take many forms. For example, the manifold member may include separate electrodes on opposite sides of the donor substrate and receiver sheet for the application of the field or they may be directly on the back surfaces of these members and integral therewith. Alternatively, one or both of the donor substrate and receiver sheet may be made of a conductive material. Conventionally, at least one of these is transparent so as to permit exposure of the imaging layer through this electrode. Where both separate electrodes and a receiving and/or donor sheet are used, the receiving sheet and receiving side electrode or the donor sheet and donor side electrode may be transparent to permit exposure of the imaging layer. The imaging layer may be exposed from either the receiver sheet side or the donor sheet side.

In one form of the manifold imaging process, an imaging layer comprising a photosensitive pigment dispersed in an insulating binder is coated on a transparent, insulating donor sheet. The donor is placed imaging layer side up on a transparent conductive electrode. The imaging layer is then activated by spraying or brushing a swelling agent or partial solvent for the imaging layer onto the surface of the imaging layer. An insulating receiver sheet is placed on the activated imaging layer. The electrode is then placed on the receiver sheet. An electric field is then applied between the electrodes and a light image is projected through the donor side electrode and donor sheet. The electrodes are then removed and the receiver sheet and donor sheet are separated providing a positive image corresponding to the light image on one of the donor and receiver sheets and a negative image on the other sheet. The manifold imaging system is described in more detail in copending application Ser. No. 708,380 filed Feb. 26, 1969 by W. G. Van Dorn, which is incorporated herein by reference.

It can be seen from the above discussion that each of the many reproduction systems described imposes specific requirements upon the imaging compositions which can be employed therewith. Moreover, each of the imaging compositions currently employed suffers certain disadvantages as exemplified above. Viewed in this light, the substantially universal applicability of the photoconductive imaging compositions of the present invention can be fully appreciated. Not only are the present imaging compositions widely useful, but they also overcome many of the disadvantages associated with currently used imaging compositions. Another advantage of the present invention is the capability it provides for providing high quality images by diverse reproduction techniques is heretofore unattainable colors.

Thus, the imaging compositions of the present invention comprise discrete, finely divided toner particles comprising a polymeric matrix colored by the presence of at least two differently colored pigment particles dispersed and bound therein, at least one of said particles or said polymeric matrix being electrically photosensitive, said toner composition exhibiting the resultant color of the differently colored pigments and being capable of forming images in said resultant color without color or particle separation.

As employed herein, the term "pigment" is intended to encompass colorants which are insoluble in the binder employed and are therefore found as a separate, usually microcrystalline, dispersed phase within the continuous binder phase or matrix. The term "pigment" as defined above is to be distinguished from the term "dye" which, as used herein, is intended to encompass pass a colorant which is soluble in the binder employed and is therefore in solution with the binder as opposed to a separate, discrete phase therein.

"Photosensitive" as used herein more particularly means "electrically photosensitive". While photoconductive materials and "photoconductive" is used in its broadest sense it is intended to mean materials which show increased electrical conductivity when illuminated with electromagnetic radiation and not necessarily those which have been found to be useful in xerography in a xerographic plate configuration, have been found to be a class of materials useful as "electrically photosensitive" materials in this invention and while the photoconductive effect is often sufficient in the present invention to provide an "electrically photosensitive" material it does not appear to be a necessary effect. Apparently the necessary effect according to the present invention is the sensitization of the material affected by light action on the surface of the "electrically photosensitive" material, by exposing said material to activating radiation; which may specifically include photoconductive effects, photoinjection, photo emission, photo chemical effects and the like.

In accordance with the present invention, the use of properly selected pigments enables any desired color to be formed. Thus, for example, using cyan, magenta and yellow in approximately equal proportions produces a black toner. Similarly, cyan can be combined with yellow to produce green or with magenta to produce blue, or magenta can be combined with yellow to produce red. Using more of one pigment than the other results in a color shift which could produce a brown-purple, blue-black or any other desired color. Combinations of two broadly absorbing pigments, such as of phthalocyanine and Indofast Orange in appropriate amounts, can also produce black. In order to obtain a black, it is thus necessary to use pigments which together absorb all the complete wavelengths of visible light such as, for example, the three primary colors or a combination of a primary color and a secondary color resulting from the remaining primary colors, and to use them in balanced proportions.

Suitable colored pigments for use in the present invention include, for example, Algol Yellow, Pigment Yellow 6, Benzidine Yellow, Vulcan Fast Yellow GR, Indofast Orange, Ortho Nitroaniline Orange, Vulcan Fast Orange GG, Dione Orange Pulp, Irgazine Red, Paranitraniline Red, Toluidine Red, Permanent Carmine FB, Permanent Bordeaux FRR, Romanesta Red, Pigment Orange R, Vulcan Fast Rubine BF, Lake Red D, Lithol Red 2G, Double Ponceau R, Calamine Red MB, Pigment Scarlet 3B, Acid Alizarine Red B, Rhodamine 6G, Rhodamine B Lake, Methyl Violet B Lake, Gentian Violet Lake, Quinizarin, Victoria Pure Blue BO Lake, Ethylviolet Lake, Phthalocyanine Blue B Pr, Pigment Blue BCS, Peacock Blue Lake, Brilliant Green B, and the like.

Typical photosensitive organic materials include substituted and unsubstituted organic pigments such as phthaocyanines, for example, copper phthalocyanine, beta form of metal-free phthalocyanine; tetrachlorophthalocyanine; and *x*-form of metal-free phthalocyanine; quinacridones, as, for example, 2,9-dimethyl quinacridone; 4,11-dimethyl quinacridone; 3,10-dichloro-6-13-dihydroquinacridone; 2,9-dimethoxy-6,13-dihydroquinacridone and 2,4,9.11-tetrachloroquinacridone; anthraquinones such as 1,5-bis-(beta-phenylethylamino) anthraquinone; 1,5-bis-(3'-methoxy-propylamino) anthraquinone; 1,2,5,6-di-(C,C'-diphenyl)-thiazole-anthraquinone; 4-(2'-hydroxy-phenylmethoxyamino) anthraquinone; triazines such as 2,4-diaminotriazine; 2,4-di-(1'-anthraquinonyl-amino-6-(1''-pyrenyl)-triazine; 2,4,6 tri-(1'-1'', 1'''-pyrenyl)-triazine; azo compounds such as 2,4,6-tris (N-ethyl-p-aminophenylazo) phloroglucinol; 1,3,5,7-tetrahydroxy-2,4,6,8-tetra (N-methyl-N-hydroxy-ethyl-p-aminophenylazo) naphthalene; 1,3,5-trihydroxy-2,4,6-tri(3'-nitro-N-methyl-N-hydroxy-methyl-4'-aminophenylazo) benzene; metal salts and lakes of azo dyes such as calcium lake of 6-bromo-1 (1'-sulfo-2-naphthylazo)-2-naphthol; barium salt of 6-cyano-1 (1'-sulfo-2-naphthylazo)-2-naphthol; calcium lake of 1-(2'-azonaphthalene-1'-sulfonic acid)-2-naphthol; calcium lake of 1-(4'-ethyl-5'-chloroazo-benzene-2'-sulfonic acid)-2-hydroxy-3-naphthoic acid; and mixtures thereof. Other organic pigments include polyvinylcarbazole; trisodium salt of 2-carboxyl phenyl azo (2-naphthiol-3,6-disulfonic acid; N-isopropyl-carbazole; 3-benzylidene amino-carbazole; 3-amino-carbazole; 1-(4'-methyl-5'-chloro-2'-sulfonic acid) azobenzene-2-hydroxy-3naphthoic acid; N-2" pyridyl-8,13-dioxodinaphtho-(2,1-b;2', 3'-d)-furan-6-carboxamine; 2-amino-5-chloro-p-tolune sulfonic acid and the like.

The *x*-form of metal free phthalocyanine, described in U.S. Pat. No. Re. 27,117, is preferred because of its excellent photosensitivity and intense coloration.

Typical inorganic photosensitive compositions include cadmium sulfide, cadmium selenide, cadmium sulfo-selenide zinc oxide, zinc sulfide, sulfur, selenium, antimony sulfide, lead oxide, lead sulfide, arsenic sulfide, arsenic-selenium, and mixtures thereof.

The pigments exemplified herein above can be readily dispersed in a polymeric matrix to form the imaging compositions of the present invention. Any suitable natural, modified natural or synthetic resin which is essentally not dissolved by the insulating vehicle or binder may be introduced so as to cement or encapsulate the described pigment particles. These materials are normally electrically insulating having a resistivity of about $10^8$ ohm-cms. or greater and are essentially solid materials at ambient temperatures. If desired, the polymeric matrix can, itself, be photosensitive thereby obviating the need for employing at lest one photosensitive pigment. Typical synthetic polymers include vinyl-type polymers having the characteristic monomeric structure: $>C{=}C<$, and made, for example, from the following vinyl monomers: Esters of saturated alcohols with mono and polybasic unsaturated acids such as alkyl acrylates, methacrylates and haloacrylates, diethyl maleate, and mixtures therof; vinyl and vinylidene halides such as vinyl chloride, vinyl fluoride, vinylidene chloride, vinylidene fluoride, tetrafluoroethylene, chlorotrifluoroethylene and mixtures thereof; vinyl esters such as vinyl acetate, unsaturated aromatic compounds such as styrene and various alkyl styrenes, alpha-methyl styrene, parachlorostyrene, parabromostyrene, 2,4-dichlorostyrene, vinyl naphthalene, paramethoxystyrene and mixtures thereof; unsaturated amides such as acrylamide, methacrylamide and mixtures thereof; unsaturated nitriles such as acrylonitrile, methacrylonitrile, haloacrylonitrile, phenylacrylonitrile, vinylidene cyanide, and mixtures thereof; N-substituted unsaturated amides such as N,N-di-methyl acrylamide, N-methyl acrylamide and mixtures thereof; conjugated butadienes such as butadiene, isoprene and mixtures thereof; unsaturated ethers such as divinyl ether, diallyl ether, vinyl alkyl ether and mixtures thereof; unsaturated ketones such as divinyl ketone, vinyl alkyl ketone and mixtures thereof; unsaturated aldehydes and acetals such as acrolein and its acetals, methacrolein and its acetals, and mixtures thereof; unsaturated heterocyclic compounds such as vinyl pyridine, vinyl furan, vinylcoumarone, N-vinyl carbazole, and mixtures thereof; unsaturated alicyclic compounds such as vinyl-cyclopentane, vinyl-cyclohexane and mixtures thereof; unsaturated thio compounds such as vinyl thioethers; unsaturated hydrocarbons such as ethylene, propylene, coumarone, indene, terpene, polymerizable hydrocarbon fractions, isobutylene and mixtures thereof; allyl compounds such as allyl alcohol, allyl esters, diallyl phthalate, triallylcyanurate and mixtures thereof; as well as condensation polymers including polyesters, such as linear, unsaturated and alkyd types made, for example, by reacting a difunctional acid or anhydride such as phthalic, isophthalic, terephthalic, malic, maleic, citric, succinic, glutaric, adipic, tartaric, pimelic, suberic, azelaic, sebacic and camphoric with a polyol such as glycerine, ethylene glycol, propylene glycol, sorbitol, mannitol, pentaerythritol, diethylene glycol and polyethylene glycol; polycarbonates such as bisphenol esters of carbonic acid; polyamides such as those made by reacting diamines with dibasic acids where the diamines contain from 2 to 10 carbon atoms and the acids contain from 2 to 18 carbon atoms; polyethers such as the epoxy type made, for example, by condensing epichlorohydrin with any one of bisphenol A, resorcinol, hydroquinone, ethylene glycol, glycerol, or other hydroxyl containing compounds; other polyethers made, for example, by reacting formaldehyde with difunctional glycols; polyurethanes prepared, for example, by reacting a diisocyanate such as toluene-2,4-diisocyanate methylene bis (4-phenylisocyanate), bitalylene diisocyanate, 1,5-naphthalene diisocyanate, and hexamethylene diisocyanate with a dihydroxy compound; phenol aldehyde resins made, for example, by condensing resorcinol phenol or cresols with formaldehyde furfural or hexamethylene tetramine; urea formaldehyde; aelamine formaldehyde; polythioethers; polysulfonamides; alkyl, aryl and alkaryl silicones, etc.

Any suitable mixture, copolymer or terpolymer of the above materials may be used in the process of this invention.

Polymers of the types defined above include polyvinyl butyral, copolymers of methacrylic acid with methylmethacrylate, with acrylonitrile or with styrene, copolymers of vinyl acetate with maleic anhydride, copolymers of nitrostyrene with diethylmaleate, copolymers of styrene with acrylic and methacrylic acids and esters, etc.

Typical natural and modified natural resins include rosin, hydrogenated rosin, waxes, gums fossil resins, protein resins such as zein, asphaltum and others.

Illustrative of such resins are those such as described in U.S. Pat. No. 2,659,670 to Copley which describes a rosin-modified phenol-formaldehyde resin; U.S. Pat. No. Re. 25,136 to Carlson which describes a resin of styrene polymers and copolymers and U.S. Pat. No. 3,079,342 to Insalaco, describing a plasticized styrene-methacrylate copolymer resin.

Photosensitive polymers which form useful polymeric matrices in the present invention include poly(vinyl carbazole), and the like.

it is preferred to use a low melting polymeric material so as to aid in the fixing phase of the process. The normal mechanical shear stresses generated by rollers or other devices to which the imaging compositions of the present invention are subjected during manufacture or use or the varying photosensitivity or spectral response of the individual particles do not cause separation of the different colored pigment particles so that a true black or other predetermined well defined color combination image can be formed by the simultaneous migration or deposition of the bound or cemented particles.

the imaging compositions of the present invention can be prepared by thoroughly admixing the softened resin and pigments to form a uniform dispersion of the pigments in a resin matrix as by blending these ingredients in a rubber mill or the like and then pulverizing the resultant material to form it into small particles. This divisionn of the resin-pigment dispersion into discrete particles can be accomplished by jet pulverization of the material or by spray drying techniques such as described in U.S. Pat. No. 3,326,848 to C. F. Clemens et al. Other techniques which can be suitably employed for preparing the finely divided imaging compositions of the present invention include freeze drying processes such as described in Canadian Pat. No. 700,824.

The photoconductive imaging compositions of the present invention can be admixed with solid or liquid vehicles or carriers therefor to form imaging or developer compositions which can be employed in xerography, electrography, TESI, electrophoretic imaging, photoelectrophoretic imaging, migration imaging, manifold imaging and other reproduction systems depending upon the particular vehicle or imaging member employed. In general, successful results have been obtained with from about 10 to 200 parts by weight of either solid or liquid vehicle or binder to about 1 part by weight of imaging composition. Preferably, the vehicle or binder to imaging composition ratio ranges from about 50:1 to about 150:1.

The solid vehicles especially those useful in xerographic or electrographic processes are generally in the form of granular carrier particles which are grossly larger than the particles of imaging composition by at least an order of magnitude of size and are shaped to roll across the image-bearing surface. Generally speaking, the carrier particles should be of sufficient size so that their gravitational force or momentum is greater than the force of attraction of the particles of imaging composition in the charged areas where the imaging composition or toner is retained on the plate. Generally, granular carrier particles of a size larger than about 30 microns are employed and preferably between about 30 and about 1000 microns. The particle size of the photoconductive imaging compositions of the present invention can range for this application from about 1 to about 30 microns. The granular carrier particles can, if desired, be somewhat larger or smaller as long as the proper size relationship to the particles of imaging composition is maintained so that the granular carrier particles will flow easily over the image surface by gravity without requiring additional means or measures to remove it.

Typical carrier materials include, for example, sodium chloride, ammonium chloride, potassium chlorate, granular zircon, granular silicon, methylmethacrylate, glass, silicon dioxide, flint shot, iron, steel, ferrite, nickel, carborundum and mixture thereof. Many of the foregoing and other typical carriers are described by L. E. Walkup et al in U.S. Pat. No. 2,638,416 and E. M. Wise in U.S. Pat. No. 2,618,552.

Any suitable liquid vehicle can be employed with the imaging compositions of the present invention to form liquid developer compositions suitable for use in electrophoretic and photoelectrophoretic development. Specific vehicles may be selected from non-polar liquids, preferably aliphatic hydrocarbons or halogenated hydrocarbons. To provide the proper balance between charge retention at high resistivity and charge dissipation at low resistivity, the vehicle preferably exhibits a resistivity of greater than about $10^9$ ohm-cm. The particles of imaging composition are readily suspended or dispersed within the vehicle. Desirably, the particular vehicles selected should have a relatively long shelf life and be compatible with the particular materials they come in contact with during the development operation. That is, the chemical attack of the particles of imaging composition by the liquid vehicle should be avoided by appropriate selection of compatible materials. Typically, liquid vehicles that may be employed are, among others, mineral oil, oleic acid, vegetable oils such as castor oil, peanut oil, sunflower seed oil, rapeseed oil, corn oil, olive oil. Additional typical vehicles include aliphatic hydrocarbons such as mineral spirits, kerosene, petroleum haptha, decane, dodecane, N-tetradecane, molten paraffin, molten beeswax, Sohio Odorless Solvent 3440 (a kerosene fraction available from Standard Oil Company of Ohio), and Isopar G (a long chain saturated aliphatic hydrocarbon available from Humble Oil Company of New Jersey), and halogenated hydrocarbons such as trichloroethylene and Freon 113 (trifluorotrichloroethane), and the like. The liquid developer may also contain a dispersant such as alkylated polyvinyl pyrrolidone to aid in dispersion of the particles of imaging composition in the vehicle and to promote absorption of the developer into the paper to which the developed image is transferred. In addition, resins such as nitrocellulose and the ester gums may be added to impart smudge resistance to the transferred print.

For the purposes of electrophoretic and photoelectrophoretic developement, it is desirable to use particles of the present photoconductive imaging composition which are relatively small in size because smaller particles produce better and more stable dispersions in the liquid carrier and, in addition, are capable of producing images of higher resolution than would be possible with particles of large size. In general, best results have been obtained with particles having an average diameter of less than about 5 microns. For optimum image density and uniformity of density across the image, particles having a diameter of about 1 micron are preferably employed.

For purposes of migration imaging, the imaging compositions of the present invention can be formed into the required photosensitive microscopically discontinuous layer by simply being dusted onto the solvent soluble or heat softenable electrically insulating layer. The imaging compositions of the present invention also can be admixed with carriers as described hereinabove and poured or cascaded over the surface of said solvent or heat softenable layer. Alternatively, especially for a binder structured imaging layer, the photosensitive particles of the present invention can be admixed and dispersed in a polymeric insulating layer. Thus, the photosensitive microscopically discontinuous layer can be formed as a layer of separate finely divided particles of the present imaging composition by any known technique or can be conveniently prepared as a dispersion in a polymeric insulating layer.

The imaging compositions of the present invention also find utility in the imaging layer of the manifold imaging member. The basic physical property desired in the imaging layer is that it be frangible as prepared or after having been suitably activated, that is, the layer must be sufficiently weak structurally s that the application of an electric field combined with the action of actinic radiation on the electrically photosensitive material will fracture the imaging layer. Further, the layer must respond to the application of an electric field, the strength of which is below that field strength which will cause electrical breakdown or arcing across the imaging layer. Another term for "cohesively weak" therefore would be "field fracturable".

One technique for achieving low cohesive strength in the imaging layer is to employ relatively weak, low molcular weight materials therein. Thus, for example, the imaging layer may comprise the imaging compositions of the present invention dispersed in a low molecular weight polymer. Also, suitable blends of incompatible materials such as a blend of a polysiloxane resin with a polyacrylic ester resin may be used in the imaging layer together with the imaging compositions of the present invention to provide a low cohesive strength layer. The thickness of the imaging layer preferably ranges from about 0.2 microns to about 10 microns. Any other technique for achieving low cohesive strength in the imaging layer may also be employed. Preferably the imaging compositions of the present invention are dispersed in any suitable insulating resin whether or not the resin itself is photoconductive. Typical resins which can be suitably employed include polyethylene, polypropylene, polyamides, polymethacrylates, polyacrylates, polyvinyl chlorides, polyvinyl acetates, polyvinyl carbazole, polystyrene, polysiloxanes, chlorinated rubbers, polyacrylonitrile, epoxy resins, phenyolics, hydrocarbon resins and other natural resins such as rosin derivatives as well as mixtures and copolymers thereof. Also microcrystalline waxes, paraffin waxes, waxes made from hydrogenated oils, and mixtures thereof can also be suitably employed.

The imaging compositions of the present invention are extremely versatile and adapted for use in a wide range of reproduction systems as shown above. In addition to versatility, the imaging compositions can be employed to overcome problems which have heretofore plagued these various reproduction systems. For example, a problem exists in developers for conventional xerographic development wherein toner is mixed with carrier beads. In the prior art the amount of toner to be included in the developer was limited. If too much toner is included a condition termed "overtoning" occurred. The main objection to such condition is the production of high background in the images developed. Of course, should the amount of toner be depleted in the developed areas then the images have reduced density. Thus, there is a range of toner concentration in a two component developer system which provides acceptable images. The occasional addition of toner to keep its proper concentration in the developer is required. Surprisingly the toner concentration range in the developer is greatly increased in such developers which employ the imaging compositions of this invention. Thus, toner concentration of from 3 to 4 times the maximum amount allowable with standard commercial toners does not produce the undesired overtoning condition. The expanded toner concentration limit permits fewer toner additions and more uniform image development particularly in a commercial environment.

Another surprising result of the imaging compositions of this invention is the observed xerographic development capability of the material. It has been found that the imaging compositions of this invention posses strong triboelectric properties which can be uniformly altered by suitable agents. The strong yet conveniently alterable tribo properties of these materials renders them highly useful in many xerographic development methods. The addition of charge contact agents produce unexpectedly great changes in the triboelectric characteristics of the toner compositions of this invention such as causing highly positive toner to be highly negative with respect to the same carrier. The above described properties of the imaging compositions of this invention renders such compositions highly desireable for use in xerographic imaging methods.

The photoconductive imaging compositions of the present invention provide a significant economic advantage in reproduction processes relying upon particle migration imaging. Heretofore, vacuum deposited selenium was most frequently employed as the photosensitive component in migration imaging systems. It is readily apparent that elimination of the vacuum deposition step offers significant economic advantage. In addition, the present invention provides a means of attaining black colored images and greatly improved projective density. Generally these particle migration systems have heretofore been confined to relatively few colors. For example, a red image from selenium, blue from phthalocyanine and the like. The imaging compositions of the present invention, however, provide essentially unlimited color capabilities and especially provide the capability of obtaining sharp high density black images exhibiting broad spectral response, high contrast, good resolution, tone reproduction and low background.

To further illustrate the imaging compositions of the present invention, the preparation and use thereof in photoelectrophoretic imaging will be described in detail below. It is to be recognized, however, that this is for purposes of illustration only as it represents only one aspect of the present invention.

The application of the present invention to photoelectrophoresis can be demonstrated by providing an imaging suspension comprising the imaging compositions of the present invention dispersed in an insulating carrier liquid. In this illustration, the imaging compositions will consist of three pigment particles, at least one of which is an electrically photosensitive pigment sensitive to visible light, representing the three principal subtractive primary colors yellow, magenta and cyan all inseparably bound or cemented together in a suitable resinous or polymeric material. Due to the presence of at least one photosensitive pigment in the resinous component, simultaneous photomigration of all the pigments bound in the particle is realized. The suspension is interpositioned between at least two electrodes and subjected to an electric field. The imaging suspension is next selectively exposed to an image to be reproduced by a source of electromagnetic radiation. The imaging suspension is generally coated on the surface of a first transparent electrode in the form of a thin film or layer and the exposure made through the transparent electrode during the period of contact with a second or imaging electrode. The photomigratory particles present in the suspension cemented together by the resinous component, respond to the exposure radiation in the imaging zone to form a visible image at one or both of the electrodes, the images being complementary in nature. When a fusible resin is used in conjunction with the photoresponsive imaging particles, the image produced may be readily fixed such as by heat or vapor fusing.

It has been determined in the course of the present invention that by incorporating at least two pigments in a suitable resin, at least one of which is electrically photosensitive and responsive to visible light, simultaneous photomigration in an electrophoretic imaging process may be achieved. It should be apparent, of course, that the resin binder which forms the matrix of the photomigration particle must be insoluble in the liquid vehicle employed. As a result of the correct selection of the pigments, a high quality color image may be obtained wherein the initial color of the image is controlled or determined by the resultant color obtained from both the photoresponsive and the non-photoresponsive particles.

The invention is further illustrated in the FIGURE of the accompanying drawing in which there is seen a continuous monochrome photoelectrophoretic duplicator comprising transparent injecting electrode 1 and an imaging or blocking electrode 10.

The transparent injecting electrode 1, in the instant illustration, is represented as consisting of a layer of optically transparent glass 2 overcoated with a thin optically transparent layer of tin oxide 3. Tin oxide coated glass of this nature is commercially available under the trade name "NESA" glass. A uniform layer of the imaging suspension 5 of the present invention is coated on the surface of the transparent electrode by an applicator 6 of any suitable design or material, such as a urethane coated cylinder, which may rotate in the same direction or, as herein represented, in the opposing direction to the transparent cylinder which also aids in cleaning NESA surface prior to re-application of ink. The function of the ink applicator is to apply a thin film of the imaging suspension from ink sump 7 by way of rollers 8 and 6 to the transparent cylinder 2. In close proximity to the transparent roller electrode 1 is a second rotary electrode or blocking electrode 10 having a conductive central core 11 which is covered with a layer of material 12, the function of which is to block the rapid exchange of electric charges between the particles and the injecting electrode 1, such as polyurethane. Although this layer of material need not necessarily be used in this system, the use of such a layer is preferred because of the markedly improved results which it is capable of producing. A detailed description of the improved results and the types of materials which may be employed as the blocking layer may be found in U.S. Pat. No. 3,383,993.

A receiver sheet 13 is driven between cylinders 1 and 10 as represented, with an ink imaging being selectively deposited on the receiver sheet in the imaging zone. A residual image pattern opposite in image sense to the image developed on the receiver sheet is formd on the NESA glass cylinder which is removed at the ink application station. Thus the applicator performs both the ink application and residual image removal steps.

As the imaging suspension enters the imaging zone between the injecting and blocking electrodes, an image is projected into the nip of the rollers by way of a first surface mirror designated 39 while a field is established across the imaging zone as the result of power source 35. Through the entire operation the NESA glass roller electrode is connected to ground. The receiver sheet 13 herein represented in the form of a paper web is fed from a supply roll 36 passes between the glass transparent injecting electrode and the imaging electrode and is rewound on takeup roller 37. A heated metallic shoe 38 in contact with the underside of the paper web supplies the energy for fixing.

A wide range of voltages at which imaging occurs may be applied between the electrodes of the photoelectrophoretic system. It is preferred in order to obtain good image resolution that the potential be such as to create an electric field of at least about 60 volts per micron across the imaging layer. The applied potential necessary to obtain the desired field strength will of course vary depending upon the interelectrode gap and upon the thickness and type of blocking material used on the respective imaging electrode surface. Voltages as high as 8,000 volts have been applied to produce images of high quality. The upper limit of the field strength is limited only by the breakdown potential of the suspension and blocking electrode material.

Imaging as carried out in conjunction with the photoelectrophoretic process of the present invention will generally be in a negative to positive or positive to negative imaging mode. Thus, for purposes of the present discussion, in order to produce a positive image on the receiver sheet, a negative image is projected onto the nip passing the imaging suspension. As discussed above a potential is applied across the imaging suspension and as a result of the exposure to the actinic radiation the exposed imaging particles initially suspended in the carrier liquid migrate through the carrier to the surface of the imaging roller or, in the instance of the above described illustration, to the surface of the intervening receiver paper sheet. The pigment image formed, whether it be on a removable blocking electrode layer attached to the conductive core of the imaging roller or to a receiver copy sheet may be fixed in place, for example, by placing a lamination over its top surface such as by spraying with a thermoplastic composition or by the application of heat such as by the utilization of a heated metallic shoe which is in contact with the underside of the paper web as in the present illustration. When a fusible polymeric material such as a thermoplastic resin is utilized in conjunction with the pigmet particles, the system of the present invention presents a built-in image fixing mechanism when utilizing heat fixing or vapor fixing techniques. In addition, the application of heat further assists in the fixing process by accelerating the removal of carrier liquid from the image areas. If desired, the image may be transferred to a secondary substrate to which it is in turn fixed. The system herein described produces a high contrast monochromatic color image, black or otherwise, either in a positive to negaive or negative to positive imaging mode.

If the image is formed on a permanent electrode surface and the intervening receiver sheet is eliminated, it will be found desirable to transfer the image from the electrode and fix it on a secondary substrate so tha the electrode may be reusd. Such a transfer step may be carried out by adhesive pick off techniques or preferably by electrostatic field transfer. If the imaging roller is covered with a transfer paper sleeve or, as illustrated, a web is passed between the contacting surfaces of the transparent and imaging rollers or if the blocking material utilized consists of a removable sleeve, such as Tedlar, this intervening substrate will pick up the complete image on the initial pass and need only be removed to produce the final usable copy. All that is required is to replace the substrate with a similar material. In the present configuration images are produced directly on a paper receiving sheet or other substrate with the image formed on the NEAA or transparent cylinder removed by the action of the ink applicator. However, if desired, the image formed on the NESA cylinder need not be discarded but may be utilized by offsetting the image from the NESA cylinder onto the surface of a conventional receiving sheet such as described above. Any suitable material may be used as the receiving substrate for the image produced such as paper as represented in the illustration or other desirable substrates. For example, if one desires to prepare a transparency the use of a Mylar or Tedlar sheet might be desirable.

When used in the course of the present invention, the term "injecting electrode" should be understood to mean that it is an electrode which will preferably be capable of exchanging charge with the photosensitive particles of the imaging suspension when the suspension is exposed to light so as to allow for a net change in the charge polarity on the particle. By the term "blocking electrode" is meant one which is incapable of injecting the electrons into or receiving electrons from the above mentioned photosensitive particles at a negligible rate as compared to the injecting electrode when the particles come into contact with the surface of the electrode.

It is preferred that the injecting electrode be composed of an optically transparent material, such as glass, overcoated with a transparent or semitransparent conductive material such as tin oxide, indium oxide, copper iodide, aluminum or the like; however, other suitable materials including many semiconductive material such as raw cellophane, which are ordinarily not thought of as being conductors but which are still capable of accepting injected charge carriers of the proper polarity under the influence of an applied electric field may be used. The use of more conductive materials allows for cleaner charge separation and prevents possible charge buildup on the electrode, the latter tending to diminish the electric field across the suspension in an undesirable manner. The blocking electrode, on the other hand, is selected so as to prevent or greatly retard the injection of electrons into the photosensitive pigment particles when the particles reach the surface of this electrode. The core of the blocking electrode generally will consist of a material which is fairly high in electrical conductivity. Typical conductive materials include conductive rubber, steel, aluminum, copper and brass. Preferably, the core of the electrode will have a high electrical conductivity in order to establish the required plurality differential in the system; however, if a material having a low conductivity is used, a separate electrical connection may be made to the back of the blocking layer of the blocking electrode. For example, the blocking layer or sleeve may be a low conductivity polyurethane material having a resistivity of from about $10^8$ to $10^9$ ohm-cm. If a hard rubber, non-conductive core is used, then a metal foil may be used as a backing for the blocking sleeve. Although a blocking electrode material need not necessarily be used in the system, the use of such a layer is preferred because of the markedly improved results which it is capable of producing. It is preferred that the blocking layer, when used, be either an insulator or a semiconductor which will not allow for the passage of sufficient charge carriers, under the influence of the applied field, to discharge the particles finely bound to its surface thereby preventing particle oscillation in the system. The result is enhanced image density and resolution. Even if the blocking layer does allow for the passage of some charge carriers to the photosensitive particles, it still will be considered to fall within the class of preferred materials if it does not allow for the passage of sufficient charge so as to recharge the particles to the opposite polarity. Exemplary of the preferred blocking materials used as baryta paper, Tedlar or polyvinyl fluoride, Mylar (polyethylene terephthalate), and polyurethane. Any other suitable material having resistivity of from about $10^7$ ohms-cm or greater may be employed. Typical materials in this resistivity range include cellulose acetate coated papers, cellophane, polystyrene and polytetrafluoroethylene. Other materials that may be used in the injecting and blocking electrodes and other photosensitive particles which can be used as the photomigratory pigments in the imaging composition of the present invention and the various conditions under which the system operates may be found in the above cited issued patents U.S. Pat. Nos. 3,384,565 and 3,384,566 as well as U.S. Pat. Nos. 3,384,488 and 3,389,993.

In photoelectrophoresis, the imaging composition of the present invention comprises a dispersion of at least two differently colored pigment particles, wherein at least one of said pigment particles is electrically photosensitive, in an insulating carrier liquid or vehicle. The pigment particles are selected so that when cemented together in a polymeric matrix, they produce the desired color effect. Generally speaking, the instant invention is advantageously employed to produce high quality black images. However, if desired, any combination of pigment particles may be combined in the particular resin or polymeric materials so as to produce a desired color effect. Any suitable differently colored pigments may be employed in conjunction with the present invention such as disclosed in U.S. Pat. Nos. 3,384,566 and 3,384,565. The imaging suspension may also contain a sensitizer for the pigment particles.

High quality black ink may be obtained in accordance with the present invention from a mixture of x-phthalocyanine disclosed in U.S. Pat. No. 3,357,989 having a common assignee, Irgazine Red as described in U.S. Pat. No. 2,973,358 and commercially available from Geigy Chemical Corp., and Algol Yellow, (1,2,5,6-di(C,C'-diphehyl)thiazoleanthraquinone) available from General Aniline & Film Corp., the tri-mix being inseparably bound within a suitable resinous material such as a low molecular weight polyethylene.

The resinous treated pigments of the present invention may be prepared by any suitable technique which will produce the desired results. In one approach, generally referred to as thermal crystallization, the desired pigments are separately ball milled in Sohio Odorless Solvent 3454 to the desired particle size generally ranging from about 0.5 to about 2.0 microns. The resulting particles are approximately comparable in size for all the pigments. The milled particles are blended together by the use, for example, of a sonifier or ultrasonic mixer. The resulting blend is added to and dispersed in a suitable resin. For example, a low molecular weight polyethylene is placed in a molten condition by heating it to a temperature of about 200° C. in a suitable vehicle, such as Sohio Odorless Solvent 3454, and the pigment blend added thereto. The resulting dispersion is cooled while under continuous agitation with the polymeric resinous material crystallizing out at room temperature and an encapsulation effect is realized so that the pigment particles are cemented together in an agglomeration to form particles ranging in size of from about 5 to 10 microns.

A second technique which may be utilized is referred to as spray drying. In the spray drying technique the desired pigment materials are pre-milled in a solvent such as methyl-ethyl ketone and blended together ultrasonically as in the above described process. The resulting blend is spray dried in the presence of a dissolved resinous material such as a styrene-n-butyl methacrylate copolymer or low molecular weight polyethylene using conventional laboratory spray drying equipment. Particles ranging in size of from about 5 to 7 microns are produced. After drying the particles are redispersed by, for example, sonifying or milling in an insulating vehicle prior to imaging.

The above mentioned techniques serve merely as illustrations of the various methods available by which the pigment particles of the present invention may be cemented or bound together in a polymeric matrix resulting in a relatively small imaging particle generally less than about 10 microns. Typically, such processes include emulsion polymerization, interfacial polymerization, hot melt milling and pulverization. The resulting imaging particle constitutes a new photoconductive imaging composition, the resultant color which depends upon the type of pigments used and relative quantity of each.

In photoelectrophoretic systems, therefore, it is seen that the imaging compositions of the present invention will not undergo color separation since the individual pigment particles are bound in a polymeric matrix. The composite imaging composition will undergo migration because of particles therein which are photosensitive to a particular wavelength of light. The other pigment particles, although they may enhance photoconductivity, are incorporated to form a particular resultant monochromatic colored image. Thus, the imaging compositions of the present invention differ from imaging compositions conventionally employed in photoelectrophoretic systems such as those described in U.S. Pat. No. 3,384,566 to H. E. Clark. In that patent, the imaging suspension consists of multiple unbound particles each of which is photoconductive; thus, when exposed to light each undergoes migration with respect to the exposed radiation to form a colored image which could be any color depending upon the choice of the particles and the exposure wavelength. In contradistinction, the imaging compositions of the present invention will always form the same color image and will not undergo color separation or color shift due to changes in the exposure wavelength. In the present invention, the sensitivity of the particle of imaging composition is dependent upon the photosensitive pigment or pigments present and its or their corresponding wavelength sensitivities but the resulting color is always the same as originally formulated. Thus, in the present invention, the resulting final image color is determined by initial selection and blending of pigments and not by the migration of separate particles in response to the exposure wavelength.

The imaging compositions of the present invention are also to be distinguished from imaging compositions which rely upon superimposition of different transparent colored particles such that when the layers of the respective colored particles are superimposed, they produce the desired color. Compositions of this latter type are described in U.S. Pat. No. 3,345,293 to J. S. Bartoszewicz et al. In the present invention, however, the resultant color of the imaging composition is determined by the absorption and reflection characteristics of the discrete pigment particles in the imaging composition.

The following examples further define, describe and compare methods of preparing the imaging compositions of the present invention and of utilizing these compositions to reproduce images. Parts and percentages are by weight unless otherwise indicated.

EXAMPLE 1

Preparation of Imaging Compositions

Each of the following materials was charged to a separate polyethylene jar partly filled with ⅛ inch steel shot and milled in such jar for 2 hours:

- 48 grams of Irgazine Red in 225 cc. of methyl ethyl ketone
- 18 grams Algol Yellow in 300 cc. of methyl ethyl ketone
- 30 grams "X" phthalocyanine in 300 cc. methyl ethyl ketone After milling, the pigments were combined and the shot rinsed with methyl ethyl ketone. The combined pigment-solvent mixture was sonified for 1 minute. Seventy-two grams of a copolymer of n-butyl-methacrylate and styrene (35/65) is admixed with methyl ethyl ketone and blended with the milled pigment mixtures. On a solids basis, the pigment concentration was 20%. The material was spray-dried in a Bowen 30 inch diameter laboratory spray dryer employing heated air and a 2 inch diameter centrifugal atomizing disc, resulting in an apparently black, i.e., black to the eye, imaging composition having an average particle size of about 7 microns. The resulting product was print-tested in a Xerox Model D xerographic apparatus at a 1 to 300 ratio of imaging composition to carrier in the developer. The carrier employed was 250 micron steel beads having a 10% coating thereon of a styrene-n-butyl methyacrylate copolymer as described in U.S. Pat. No. 3,079,342. Also included in the developer is a 0.5% by weight of imaging composition of colloidal pyrogenic silica pigment for charge control of the imaging composition. Positive dense black images were obtained and thermally fused to paper. The images exhibited excellent image quality and very low background.

EXAMPLE 2

A black imaging composition for use in photoelectrophoresis was prepared as follows:

Each of the following material was changed to a separate polyethylene jar partly filled with ⅛ inch steel shot and milled in such jar for 2 hours to obtain an average particle size of about 0.1 microns:

- 3 grams Algol yellow in 50 cc. 1,4 dioxane
- 5 grams x-form metal free phthalocyanine in 50 cc. 1,4 dioxane
- 8 grams Irgazine Red in 75 cc. 1,4 dioxane
- 3.0 grams polyvinylcarbazole was dissolved in 25 cc. 1,4-dioxane.

After milling, the pigments were combined and the shot rinsed with 100 cc. of 1,4 dioxane. The 1,4-dioxane rinse was added to the combined pigment as was the polyvinylcarbazole solution. The mixture was then frozen solid by immersion in an isopropanol-solid carbon dioxide bath. The 1,4 dioxane was vacuum evaporated resulting in the formation of the imaging composition in the form of a powder having an average particle size of 1–2 microns. The resulting powder was dispersed in Sohio 3440 solvent (a kerosene fraction available from Standard Oil Company of Ohio) in a concentration of 0.01 grams per 100 cc. forming a black liquid developer.

The resultant liquid developer was employed for electrophoretic development using zinc oxide coated paper charged respectively by corona. Development was with grounded electrode. Positive dense black images were obtained with high image resolution.

EXAMPLE 3

A photoelectrophoretic imaging suspension was prepared employing the imaging composition described in Example 1 suspended in Sohio Odorless Solvent 3440 in an amount of about 5% by weight. The resulting imaging suspension was coated on a NESA glass substrate through which exposure was made. The NESA glass surface was connected in series with a switch, a potential source and the conductive center of a blocking electrode roller having a coating of baryta paper on its surface. The roller was approximately 2½ inches in diameter and was moved across the plate surface at about 2 in. per second. The plate employed was about 4 inch square and was exposed with a light intensity of 90 foot candles. The magnitude of the applied potential was +6500 volts. Exposure was made with a Tungsten-iodine lamp operated at 3200° K color temperature. The original employed was a silver halide negative black and white line copy transparency. The resulting black image was of excellent quality with excellent density and low background.

In the following photoelectrophoretic imaging examples the NESA injecting electrode consists of a Pyrex glass cylinder concentric to about 0.001 inch with a conductive tin oxide coating. The imaging electrode consists of a conductive steel core with polyurethane forming the blocking layer. A continuous paper web was passed between the two electrodes.

EXAMPLE 4

A black imaging composition for use in photoelectrophoresis was prepared as follows:

Each of the following materials was charged to a separate polyethylene jar partly filled with ⅛ inch steel shot and milled in such jar for 2 hours to obtain an average particle size of about 0.1 microns:

3 gms. Algol yellow in 50 cc. cyclohexane
5 gms. *x*-form metal free phthalocyanine in 50 cc. cyclohexane
8 gms. Irgazine Red in 75 cc. cyclohexane
3.0 gms. Kraton 4113 rubber (Shell Chemical Co.) was dissolved in 25 cc. cyclohexane.

After milling, th pigments were combined and the shot rinsed with 100 cc. of cyclohexane. The rinse cyclohexane was added to the combined pigments as was the rubber solution. The resulting mixture was sonified to form a uniform dispersion. The mixture was then frozen solid by immersion in a isopropanol-solid carbon dioxide bath. The cyclohexane was vacuum evaporated resulting in the formation of the imaging composition in the form of a powder having an average particle size of 1–2 microns. The resulting powder (19 gms.) was dispersed in 200 cc. of Sohio 3454 solvent (a kerosene fraction available from Standard Oil Company of Ohio) forming a black imaging suspension.

The resulting imaging suspension is coated on the surface of the NESA electrode. The film of imaging suspension is metered to a thickness of about 3 microns. As the film passes the nip between the transparent and imaging electrode, a potential of about +8,000 volts is developed across the suspension. A silver halide negative image is projected into the imaging zone. A 500 watt quartz iodine light source is used to project light through the film negative. The light passes through an optical system and the image is projected into the imaging nip by way of a first surface mirror. Imaging speed is about 5 inches per second. A black image having a white light print density of about 1.0 with a background density of about 0.01 is obtained.

EXAMPLE 5

A black imaging composition for use in photoelectrophoresis was prepared as follows:

Each of the following mixtures was milled separately with 100 grams of steel shot in a polyethylene jar for 4 hours:

8 grams Watchung Red B (C.I. 15865) in 75 cc. of Sohio 3454 solvent.
5 grams "x" phthalocyanine in 50 cc. of Sohio 3454 solvent
3 grams Algol Yellow (C.I. 67300) in 50 cc. of Sohio 3454 solvent After milling, each jar was rinsed with 25 cc. of Sohio 3454 solvent. The pigment and the rinse solvent were then combined and sonified for 1 minute.

The resulting pigment dispersion was heated to 250° F. 9.0 grams of Elvax 460 resin (an ethylene vinyl acetate copolymer manufactured by E. I. Dupont de Neumours & Co.) was combined with the above pigment mixture. The resulting mixture was allowed to cool slowly to ambient temperature (70° F.) with continuous stirring forming encapsulated pigment particles. 0.1 Gram of β-carotene (manufactured by Eastman Kodak) was combined with 5 cc. of naphtha. 36 Grams of piccotex 75 (manufactured by the Penn. Industrial Chemical Corp.) in 25 cc. of Sohio 3454 solvent heated to 250° F. and combined with the β-carotene mixture. The resulting mixture was quenched with continuous stirring in an ice bath. The quenched mixture was recovered and admixed with the pigment mixture and 100 cc. of Sohio 3454 solvent under ambient conditions to form a black imaging suspension.

Employing the photoelectrophoretic procedure described in Example 4, the film of imaging suspension was coated to a thickness of 4 microns. Operating speed was about 4 inches per second. The resulting black images obtained exhibited a white light print density of about 0.86 and a background density of about 0.02.

EXAMPLE 6

The process of Example 5 is repeated as above except that the cyan pigment used in Monarch Blue G (Imperial Color and Chem. Co.) in place of "X" phthalocyanine. There results a black ink. Imaging speed is about 3 inch per second producing image density of 0.65 and background density of 0.02.

EXAMPLE 7

The process of Example 5 is repeated as above except that the magenta pigment utilized is Lithol Rubine Red Toner DK, C.I. 15850 (Holland-Suco Co.). This material is imaged at 5inch/sec. with resulting image density of 0.54 and background density of 0.03.

EXAMPLE 8

The process of Example 5 is repeated as above with the exception that the cyan pigment is replaced by the beta form of metal free phthalocyanine. The material is imaged at 4inch/sec. and results in image densities of 0.6 and background density of 0.01.

EXAMPLE 9

The process of Example 5 is repeated as above except the magenta pigment is replaced by Monastral Red B (duPont Co.). The material is imaged at 3inch/sec. and results in image densities of 0.65 and background densities of 0.04.

EXAMPLE 10

The process is repeated as above except the yellow pigment is Yellow 96 disclosed in U.S. Pat. No. 3,447,922 and the magenta pigment is Watchung Red B (duPont Co.). The resulting images are obtained at 4inch/sec. and results in image densities of 0.55 and background densities of 0.03.

EXAMPLE 11

The process of Example 5 is repeated except that the yellow pigment is omitted and only the phthalocyanine and Irgazine pigments are used. Violet or purple images are formed at 7inch/sec. which have a density of 0.6 and background density of 0.02.

EXAMPLE 12

The process of Example 5 is repeated as above except that 8 gms. of Quindo Magenta is substituted for the Watchung Red B. A black ink is obtained. Imaging speed is about 30 inch per second producing an image density of about 0.48 and background density of about 0.03.

EXAMPLE 13

The process of Example 4 is repeated as above except that 16 gms. of cadmium sulfoselenide is substituted for the Irgazine Red resulting in a black ink. Imaging speed is about 15 inch per second producing an image density of about 0.52 and background density of about 0.06.

EXAMPLE 14

The process of Example 4 is repeated as above except that 11 gms. of Indofast Orange is substituted for the Algol yellow and the Irgazine Red. A black ink is obtained. Imaging speed is about 10 inch per second producing an image density of about 0.55 and background density of about 0.00.

EXAMPLE 15

The process of Example 4 is repeated as above except that styrene-butyl methacrylate copolymer is substituted for the Kraton 4113 rubber. A black ink is obtained. Imaging speed is about 10 inch per second producing an image density of about 1.05 and a background density of about 0.02.

EXAMPLE 16

An ink composition is prepared comprising the following formulation:

| | % concentration |
|---|---|
| Phthalocyanine "x-form" | 1.3 |
| Algol Yellow | .7 |
| Irgazine Red | 2.0 |
| Butylmethacrylate-Styrene copolymer | 8.0 |
| Methyl ethyl ketone | 88.0 |

The above materials are milled and freeze dried as described in Example 4, to a 5 micron particle size and redispersed in the following:

| | |
|---|---|
| Polyethylene AC-612 (Av MW .4000) (1) | 9.0 |
| Tricresyl phosphate | 3.0 |

-continued

| | |
|---|---|
| β-carotene (2) | .1 |
| Sperm oil | 6.5 |
| Piccotex 75 (3) | 20.0 |
| Sohio 3454 (4) | 58.6 |

(1) Allied Chemical Co.
(2) Eastman Kodak
(3) Pennsylvania Industrial Chemical Corp.
(4) Standard Oil of Ohio The resultant imaging suspension is coated and imaged in accordance with the steps of Example 4. An image having a print density of 1.5 with a background density of 0.02 is obtained at 5inch/sec.

EXAMPLE 17

The process of Example 5 is repeated with the exception that the red pigment is omitted and X-phthalocyanine and C.P. Golden Yellow #55 (CdS) available from the Shepherd Chemical Co. are used. Green images are formed at an imaging speed of about 6 inches per sec. having a density of about 0.06 and a background density of about 0.02.

EXAMPLE 18

A brownish-black imaging composition for use in photoelectrophoresis is prepared as follows:

5 parts of polyvinylcarbazole are dissolved in 95 parts toluene. The resulting solution is added to a paint shaker together with 1.25 parts Violet 92 and 1.25 parts Yellow 36 (both inorganic pigments available from Shepherd Chemical Co., Cincinnati, Ohio) and milled therein for 2 hours to obtain a uniform dispersion of the pigment in the solution. The resulting dispersion is removed from the paint shaker and spread on a suitable surface to allow the solvent to evaporate. 4 Parts of the resulting pigmented polyvinylcarbazole together with 100 parts Sohio 3454 solvent are charged to a paint shaker partly filled with ½ inch steel shot and are milled therein for 2 hours to obtain a brown-black imaging suspension comprising a dispersion of particles of pigmented polyvinylcarbazole (average particle size 1 micron) in Sohio 3454 solvent. In this instance, the polyvinylcarbazole is the only photosensitive component of the imaging composition.

Employing the photoelectrotrophoretic procedure described in Example 4, a film of the above suspension is coated on the NESA electrode to a thickness of 4 microns. Operating speed is about 4 inches per second. The resulting brownish-black images are of high white light print density with low background density.

EXAMPLE 19

A xerographic developer comprising the imaging compositions of the present invention mixed with a xerographic carrier materaial prepared in the manner described in Example 1 is cascaded several times across the surface of a 3 micron layer of Staybelite Ester 10 (Hercules Powder Company) overlying aluminized Mylar polyester film (F. duPont de Nemours, Inc.) thereby forming a plate useful in migration imaging. Such method is more fully described in U.S. Pat. No. 3,671,282 to Goffe, which patent is hereby incorporated by reference. The plate is then electrostatically charged in darkness to a positive potential of about 60 volts by means of a corona discharge device. The charged plate is exposed to an optical image wth energy in illuminated areas of $4.4 \times 10^{14}$ photons/cm$^2$/sec by means of a light source peaking at 8,000 Angstrom units. It is then immersed in cyclohexane for about 2 seconds and removed. A faithful dense black replicate of the optical image is thereby produced on the aluminized Mylar polyester substrate.

EXAMPLE 20

A manifold imaging member is prepared as follows: 5 grams of Sunoco 1290, a microcrystalline wax with a melting point of 178° F., is dissolved in 100 cc. of reagent grade petroleum ether heated to 50° C. and quenched by immersing the container in cold water to form smallwax crystals. Five grams of the imaging composition prepared in Example 1 is then added to the wax paste along with ½ pint of clean porcelain balls in a 1 pint mill jar. This formulation is then ball milled in darkness for 3½ hours at 70 r.p.m. and after milling, 20 cc. of Sohio Solvent 3440 is added to the paste. This paste is then coated in subdued green light on a 2 mil Mylar sheet with a No. 12 wire-wound drawn down rod which produces a 2.5 micron thick coating after drying. The coating is then heated to about 140° F. in darkness in order to dry it. The coated donor thus obtained is placed on the tin oxide surface of a NESA glass plate with its coating facing away from the tin oxide. A receiver sheet also of 2 mil thick Mylar is then placed on the coated surface of the donor. Then a sheet of black, electrically conductive paper is placed over the receiver sheet to form the complete manifold set. The receiver sheet is then lifted up and the layer of imaging composition in wax is activated with one quick brush stroke of a wide camel's hair brush saturated with petroleum ether. The receiver sheet is then lowered back down and a roller is rolled slowly once over the closed manifold set with a light pressure to remove excess petroleum ether. The negative terminal of an 8,000 volt d.c. powder supply is then connected to the NESA coating in series with a 5,500 megohm resistor and the positive terminal is connected to the black opaque electrode and grounded. With the voltage applied, a white incandescent light image is projected upward through the NESA glass using a Wollensak 90 mm., f 4.5 enlarger lens with illumination of approximately 1/100 foot candle applied for 5 seconds for a total incident energy of 5 foot candle seconds. After exposure, the receiver sheet is peeled from the set with the potential source still connected. The small amount of petroleum ether present evaporates within a second or so after the separation of the sheets yielding a pair of excellent quality dense black images with a duplicate of the original on the donor sheet and a reversal of the original on the receiver sheet.

EXAMPLE 21

The developer of Example 1, without the colloidal pyrogenic silica pigment, is employed in the xerographic process employing positive charging of the photoconductor. Upon cascade development a negative image is obtained.

EXAMPLE 22

The process of Example 21 was repeated except the photoconductor is charged negative. Upon development a positive image is obtained.

EXAMPLE 23

The imaging composition of Example 1, without the colloidal pyrogenic silica pigment, is added to negative working high density glass carrier beads and the thus produced developer is employed in the xerographic process wherein the photoconductor is charged positive. Upon development by the cascade method a weak negative image is obtained.

EXAMPLE 24

The process of Example 23 is repeated except the photoconductor is charged negative. A weak positive image is employed.

EXAMPLE 25

The xerographic process of Example 1 is repeated except the concentration of the colloidal pyrogenic silica is increased to about 10% by weight of the imaging composition. Again, an excellent positive image is obtained.

EXAMPLE 26

The process of Example 25 is repeated except the concentration of the imaging composition is increased 4 times its original amount. The developed image exhibited slightly higher density and no noticeable increase in background.

EXAMPLE 27

To the developer of Example 23 there is added a small amount of colloidal pyrogenic silica. As indicated by the color of the carrier beads, the imaging composition is completely removed from the beads.

EXAMPLE 28

Portions of the image formed by the image composition and process of Example 1 are caused to change color by rubbing the portions with the rounded end of a metal rod using hand pressure. In this manner the treated portions of the image appears dense green in color.

EXAMPLE 29

The image of Example 13 is treated according to the procedure of Example 28 whereby the treated portions of the image appears green.

EXAMPLE 30

The image of Example 17 is treated in accordance with the procedures of Example 28 whereby the treated portion of the image appears blue.

EXAMPLE 31

The image of Example 14 is treated in accordance with the procedure of Example 28 with the exception that a clear thermoplastic sheet is placed over the image. The metal rod is rubbed on the sheet whereby the pressure is transmitted to the image. The treated portions of the image appear blue.

EXAMPLE 32

The image of Example 8 is treated in accordance with Example 28. The treated portions of the image appear green.

EXAMPLES 33 and 34

The procedure of Example 3 is repeated except the Irgazine Red pigment in the imaging composition is replaced with Hastoperm Red (Example 33) and Quindo Magenta (Example 34). Both images are selectively treated in accordance with the procedure of Example 28 and in each instance the treated portions appear green.

EXAMPLE 35

The image of Example 16 is treated in accordance with the procedure of Example 28. The treated portions of the image appear green.

Although the present examples were specific in terms of conditions and materials used, any of the above materials may be substituted when suitable with similar results being obtained. In addition to the steps used to prepare the imaging compositions, developers and imaging members of the present invention other steps or modifications may be used if desirable.

Those skilled in the art will have other modifications occur to them based on the teachings of the present invention. These modifications are intended to be encompassed within the scope of this invention.

What is claimed is:

1. A migration imaging method comprising the steps of:

(a) providing a substrate having a layer of softenable material thereon, said softenable material being in contact with migration material, the migration material comprising an imaging composition which comprises at least two differently colored pigment particles dispersed and bound in a polymeric matrix, said particles comprising cyan, magenta, and yellow pigments, at least one of said particles or said matrix being electrically photoresponsive, said imaging compositions exhibiting the resultant color of the differently colored pigments and being capable of forming images in said resulting color without color or particle separation;

(b) subjecting said migration material to a migration force in image configuration;

(c) softening said softenable material whereby said migration material migrates in depth through said softenable material in imagewise configuration to said substrate to form an image;

(d) removing the softenable material and unmigrated material, and;

(e) selectively changing the color of said image by means of disrupting said matrix.

* * * * *